US005469644A

United States Patent [19]

Vidler

[11] Patent Number: 5,469,644

[45] Date of Patent: Nov. 28, 1995

[54] FOOTWEAR ACCESSORY

[76] Inventor: James W. Vidler, 141 Darby St., Newcastle, New South Wales 2300, Australia

[21] Appl. No.: 129,178

[22] PCT Filed: Jun. 4, 1993

[86] PCT No.: PCT/AU93/00266

§ 371 Date: Oct. 28, 1993

§ 102(e) Date: Oct. 28, 1993

[87] PCT Pub. No.: WO93/25106

PCT Pub. Date: Dec. 23, 1993

[30] Foreign Application Priority Data

Jun. 9, 1992 [AU] Australia ..... PL2828

[51] Int. Cl.[6] ..... A43B 5/00; A43B 3/18

[52] U.S. Cl. ..... 36/127; 36/132; 36/134; 36/7.7; 36/7.6

[58] Field of Search ..... 36/127, 132, 134, 36/7.2, 7.6, 7.7, 59 R, 73

[56] References Cited

U.S. PATENT DOCUMENTS

| | | | |
|---|---|---|---|
| 273,460 | 3/1883 | Cain | 36/7.3 |
| 1,749,522 | 3/1930 | Wedig | 36/7.7 |
| 1,841,710 | 1/1932 | Byrme et al. . | |
| 1,876,195 | 9/1932 | Youmans | 36/73 |
| 1,952,608 | 3/1934 | Rogers | 36/134 |
| 2,484,935 | 10/1949 | De Rooy | 36/7.7 |
| 2,628,437 | 2/1953 | Forsythe | 36/7.7 |
| 2,658,289 | 11/1953 | Schrieber | 36/7.7 |
| 2,711,596 | 6/1955 | Hoffarth | 36/7.7 |
| 2,746,174 | 5/1956 | Patterson, Jr. et al. | 36/134 |
| 3,025,615 | 3/1962 | Patton | 36/7.6 |
| 3,076,273 | 2/1963 | Wyllie | 36/7.7 |
| 3,324,578 | 6/1967 | Brutting | 36/134 |
| 3,328,901 | 7/1967 | Strickland | 36/134 |
| 3,492,744 | 2/1970 | Bernier et al. | 36/134 |
| 4,635,383 | 1/1987 | Free | 36/7.6 |

FOREIGN PATENT DOCUMENTS

| | | |
|---|---|---|
| 14595 | 5/1953 | Australia . |
| 0250634 | 7/1986 | European Pat. Off. . |
| 2103069 | of 1903 | United Kingdom . |
| 91/15972 | 10/1991 | WIPO . |

*Primary Examiner*—Paul T. Sewell
*Assistant Examiner*—Marie Denise Patterson
*Attorney, Agent, or Firm*—Jones, Tullar & Cooper

[57] ABSTRACT

An accessory for footwear including a thin, flexible, dish-shaped soleplate strapped to each sole of a pair of footwear. The soleplate contains metal spikes which extend from the lower surface of the soleplate. Each spike has a broad base embedded within the soleplate to firmly secure the spike to the soleplate. At least one pair of straps passes over the top of the footwear, and at least one strap passes around the heel of the footwear to secure the soleplate to the footwear using buckles, laces or other similar structure.

18 Claims, 6 Drawing Sheets

FOOTWEAR ACCESSORY

This invention relates to footwear, and more particularly to accessories for footwear somewhat of the nature of overshoes.

Overshoes are accessories attached to items of footwear to modify footwear for specific tasks, for example strap-on skates and ice-spurs. Numerous advantages would accrue, for an individual owner, if an accessory of this nature were available for golfers. However, the requirements for such an application are stringent as the sole of the accessory must be spiked, it must be a firm fit, and must not interfere with a person's stance in the execution of a golf stroke. Previously known footwear accessories and overshoes, referred to above, usually incorporate a solid or heavy frame which underlies both the sole and heel of the user's footwear, and are unsuitable for the present application.

It is therefore an object of the invention to provide an accessory for footwear which will effectively equip the wearer with spiked soles for use upon a golf course that will meet some or all of the abovementioned requirements.

There is disclosed herein an accessory for footwear comprising:

- a thin, flexible soleplate of an elastic plastics material having an upper surface and a lower surface;
- a plurality of spikes protruding from the lower surface of the soleplate; and
- means for releasably attaching the soleplate to a shoe or other footwear piece.

A preferred embodiment of the invention will now be described in more detail with reference to the accompanying drawings, in which.

Figure 1:
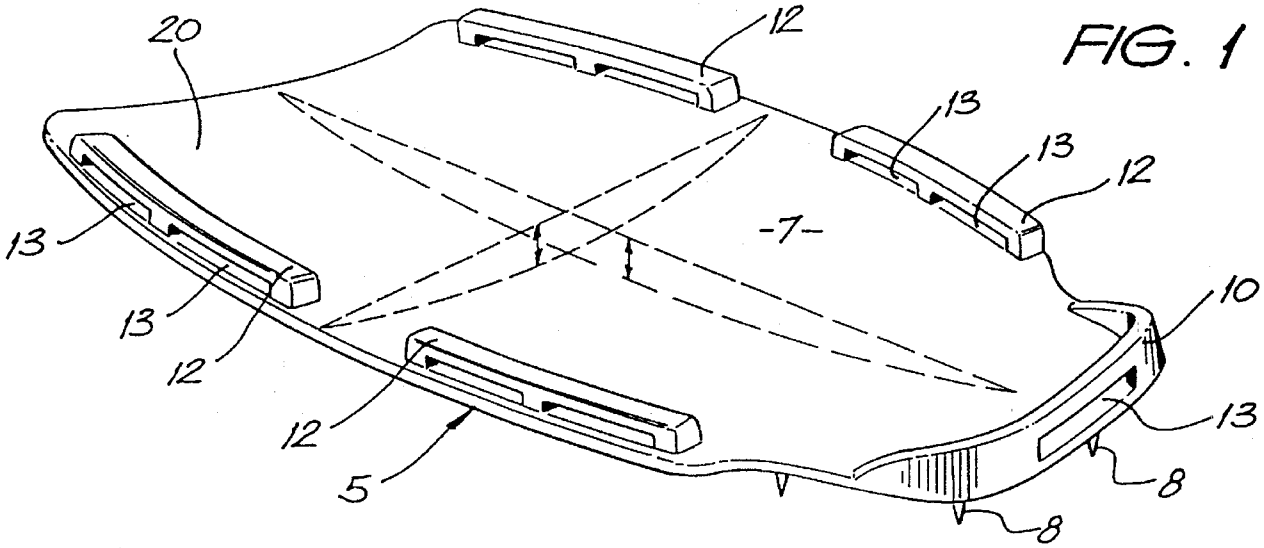
FIG. 1 is a perspective view from above of a soleplate portion of a footwear accessory constructed according to the invention.
Figure 3:
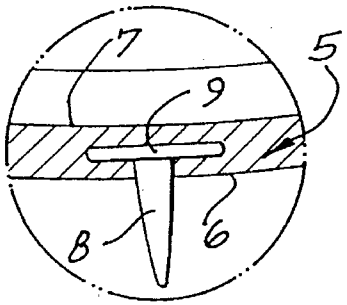
FIG. 3 shows an enlarged detail III shown in FIG. 2.
Figure 2:
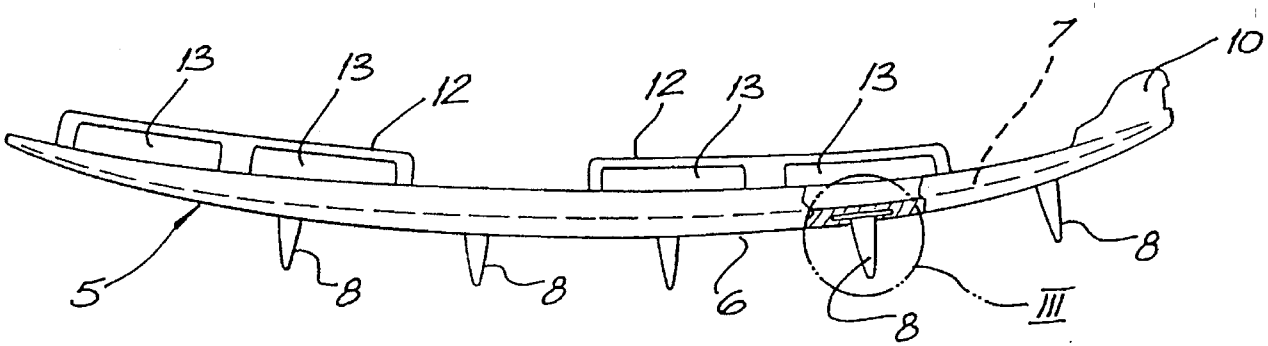
FIG. 2 is a side elevation of the soleplate of FIG. 1.
Figure 4:
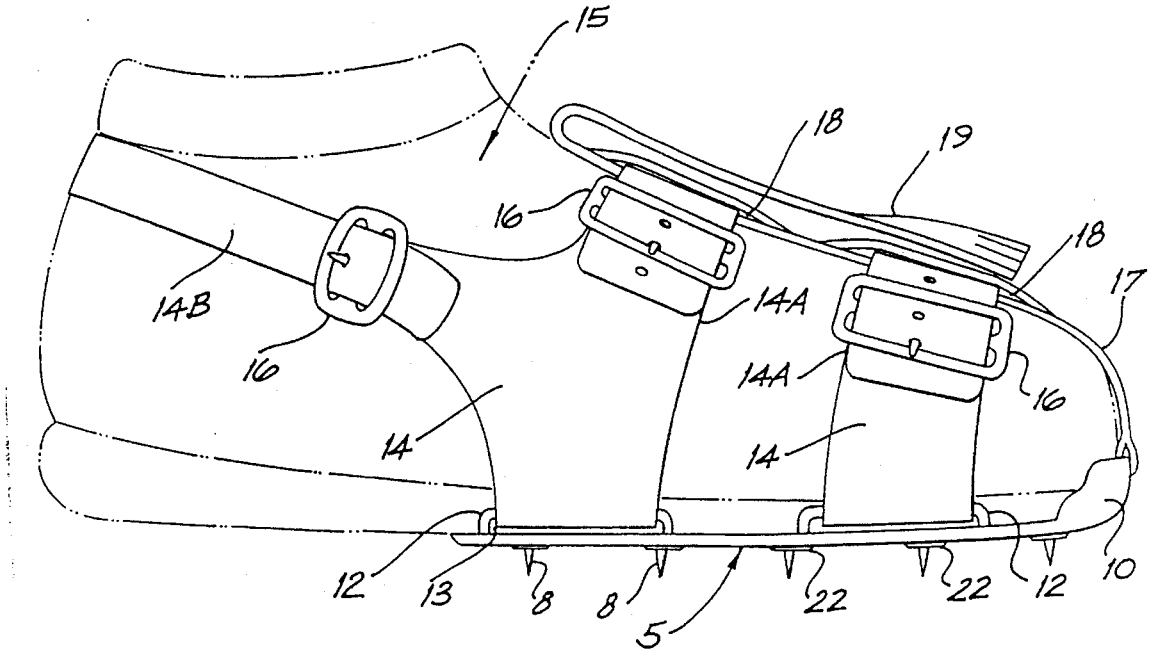
FIG. 4 shows an embodiment of this invention fitted to a jogging shoe.

FIG. 1 shows the soleplate, indicated generally at 5, being dish shaped so that the upper surface is concave. The soleplate 5 is thin and flexible and is formed from an elastic plastics material. The soleplate 5 extends under the front portion of the footwear 15 only, and not under the heel of the footwear 15, as can be seen in FIG. 4. The width of the soleplate 5 is greater than that of the footwear 15 to which it is attached, typically about 20 percent wider, and is wider than that of standard golf shoes to provide greater lateral stabilization during the golf swing.

Figure 6:
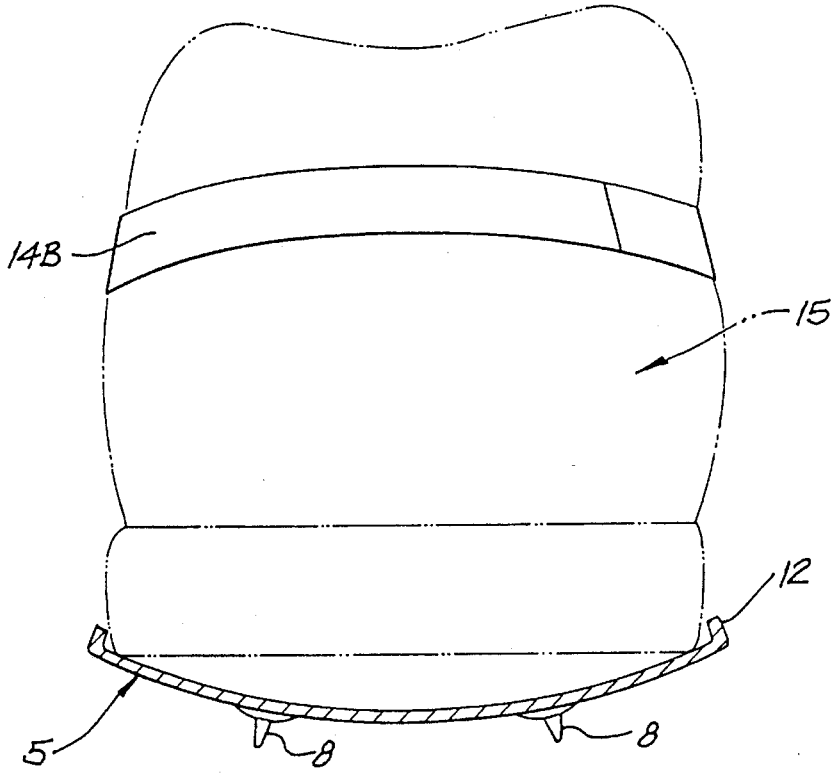
FIG. 6 is a rear elevation and partial section of the soleplate of FIG. 1 without any weight applied by, or being fastened to, a shoe.
Figure 7:
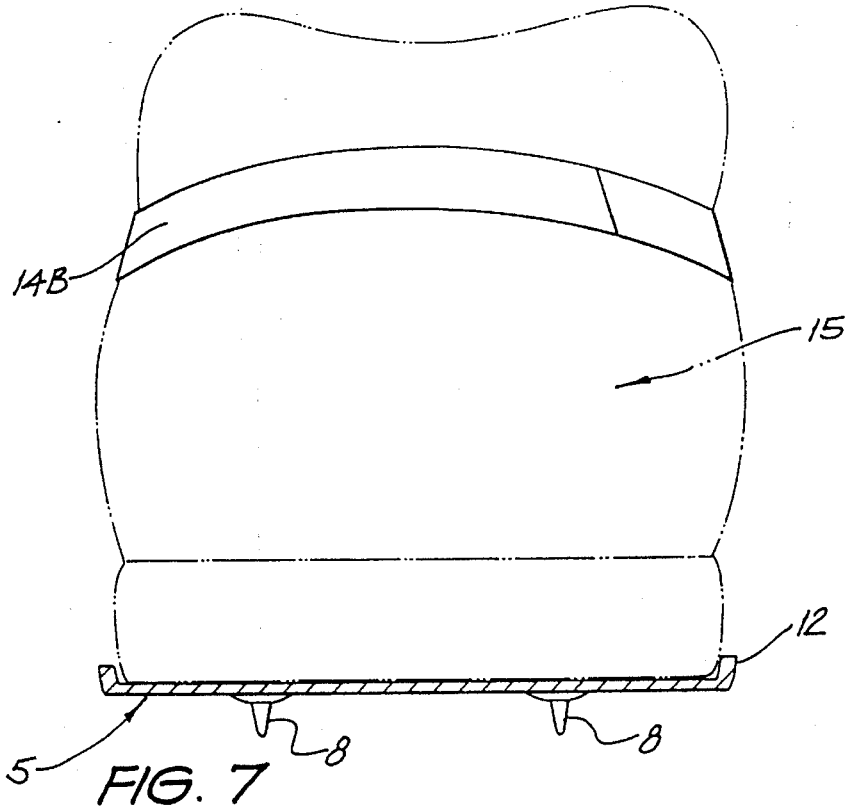
FIG. 7 is a rear elevation and partial section of the soleplate of FIG. 1 with the user's weight applied to the soleplate, and being correctly fastened to a shoe.

FIG. 6 shows the curvature of the soleplate prior to fastening the soleplate and before the user's weight is applied to the soleplate. When the user's weight is applied to the soleplate, and it is correctly fastened to the footwear, the soleplate deflects to be essentially flat, as shown in FIG. 7. The invention is most useful when used in conjunction with flat soled footwear 15, such as joggers or runners, so that when the soleplate 5 is strapped on, the major portion of the sole of the footwear 15 is in contact with the soleplate 5. See FIG. 4.

Figure 5:
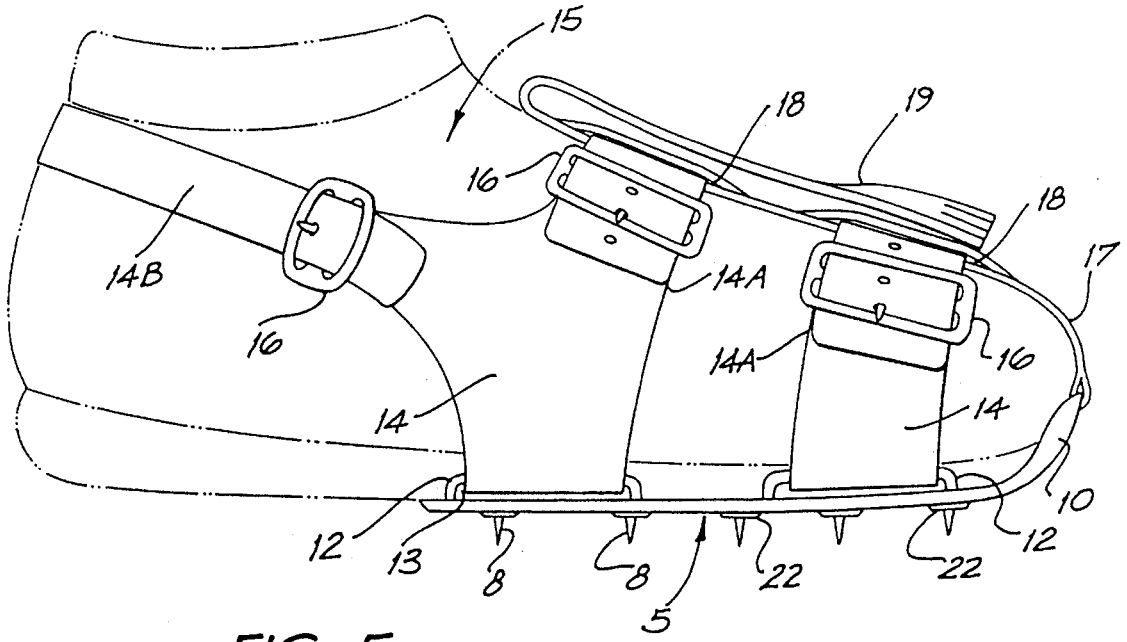
FIG. 5 shows an alternative embodiment of the invention fitted to a running shoe with an upwardly curled toe portion.

FIG. 5 shows an alternative embodiment of the soleplate 5, which comprises a soleplate 5 with an upwardly curved front portion so that the entire soleplate 5 will maintain contact with the sole of footwear 15 which has a toe portion that is curled upwards, such as certain types of running shoes. In this embodiment, at least some of the spikes are disposed further from the front of the soleplate, due to the upward curvature in the toe portion of the soleplate.

The soleplate 5 is as thin as practical, typically 1.25–1.5 mm. This is to provide the flexibility described above and to ensure that the toe portion of the footwear 15 is not raised substantially above the level of the heel of the footwear 15. This is important as the soleplate 5 does not extend under the heel of the footwear 15.

The soleplate 5 is made of injection moulded Nylon and is constructed from two layers joined together. The lower-layer 6 is made of a wear resistant Nylon suitable for use as the surface in constant contact with the ground. The upper surface 20 of the upper-layer 7 is preferably roughened, 24, to grip the sole of the user's footwear 15.

Golfing spikes 8 protrude from the lower surface 21 of the soleplate 5. The spikes 8 protruding from below the soleplate 5 are made of metal and are preferably tungsten tipped. Each spike 8 is disposed normally to the soleplate 5 and comprises a tapered shaft and a thin, broad base 9 normal to the axis of the shaft. The broad base 9 is embedded within the soleplate 5 and prevents the spike 8 from being forced through the soleplate 5. A circular boss 22 is formed from the lower layer 6 of the soleplate 5 around each spike 8 to provide a locally thickened region to firmly hold the spike 8 within the soleplate 5. Each boss 22 is small enough to be impressed into the ground under the weight of the user, in most instances, and will not, in use, raise the front portion of the footwear 15 substantially above the heel of the footwear 15. However each boss has a flat lower surface to prevent indentation of putting surfaces.

Figure 8:
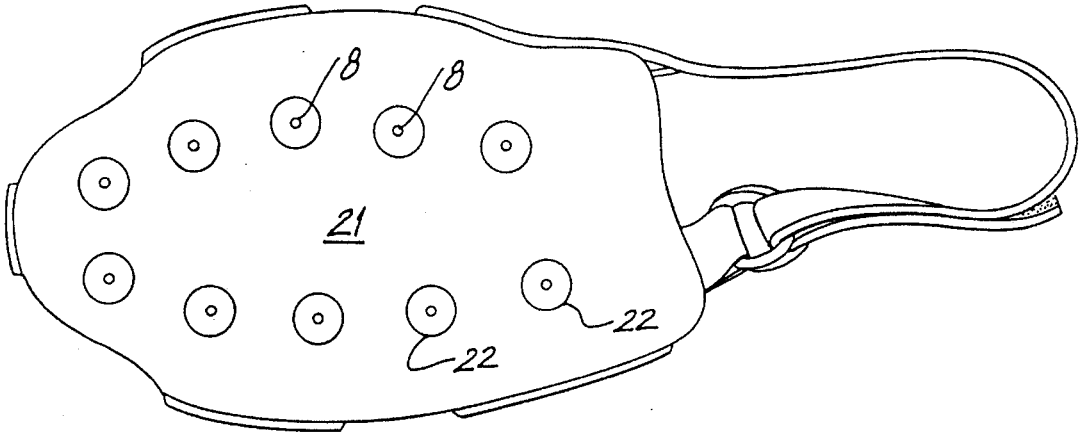
FIG. 8 is an under plan view of the invention showing the lower surface of the soleplate.

The soleplate 5 comprises two rows of spikes 8, preferably five spikes 8 in each row. These rows are bowed away from each other and generally follow the profile of the front portion of the footwear 15. See FIG. 8. Between these two rows and approximately midway along the length of the rows is a point designated the axis point. Respective spikes 8 in each row are each paired with a diagonally opposite spike 8 so that a straight line through each pair of spikes 8 will pass through the axis point. Each of the pair of diagonally opposite spikes 8 is equidistant from the axis point. As the soleplate 5 does not extend below the user's heel, there are no spikes 8 below the heel of the footwear 15. The presence of spikes 8 below the heel adds no further advantage above that already provided by the spikes 8 below the front portion of the footwear 15.

A toeplate 10 and apertured strap attachment protrusions 12 are located on the upper surface 20 of soleplate 5. The apertured upper protrusions 12 are located around the periphery of the soleplate 5, the apertures 13 taking the form of slots disposed in a longitudinal direction. This is to provide an aperture 13 suitable for attaching a thin, wide strap 14 to the protrusion 12. A wide strap 14 is preferred so that the soleplate 5 may be tightly secured to the footwear, without damaging the footwear 15 or causing discomfort to the user which might result from a thin strap applying a high pressure load to the foot. A pair of apertured protrusions 12 is located towards the front of the soleplate 5, one of each pair located on each side of the soleplate 5.

The toeplate 10, located at the front of the soleplate 5, protrudes further from the soleplate 5 than the other apertured protrusions 12. The toeplate 10 is curved to match the front of the soleplate 5, and thus is suitable for locating the toe of the user's footwear 15. The upper protrusions 12 also serve to locate the footwear 15 relative to the soleplate 5. The toeplate 10 also has a slot shaped aperture 13 for the attachment of a toestrap 17 thereto.

In an alternative embodiment, the apertured upper protrusions are replaced by brass or other metal attachment members. These are similar in shape to the apertured protrusions and serve the same function, i.e. a means for attaching straps to the soleplate. The parts of these metal attachment members embedded within the soleplate having a broad base, similar to the bases of the spikes. This is to prevent the attachment pieces from detaching from the soleplate. The toeplate is also made of brass or another metal and is secured by being partially embedded within the soleplate.

A pair of straps 14A passes over the top of the front portion of the footwear 15, one strap from each side of the soleplate 5 to be attached to one another by, in the embodiment shown in FIG. 4, a buckle member 16 on one strap 14A, and a perforated tongue portion of the second strap passing through and being secured by the buckle member 16. Although a buckle is described, any other means that would secure the straps together, such as a lace or laces passing through an appropriate aperture in each strap, could be used.

Figure 9:
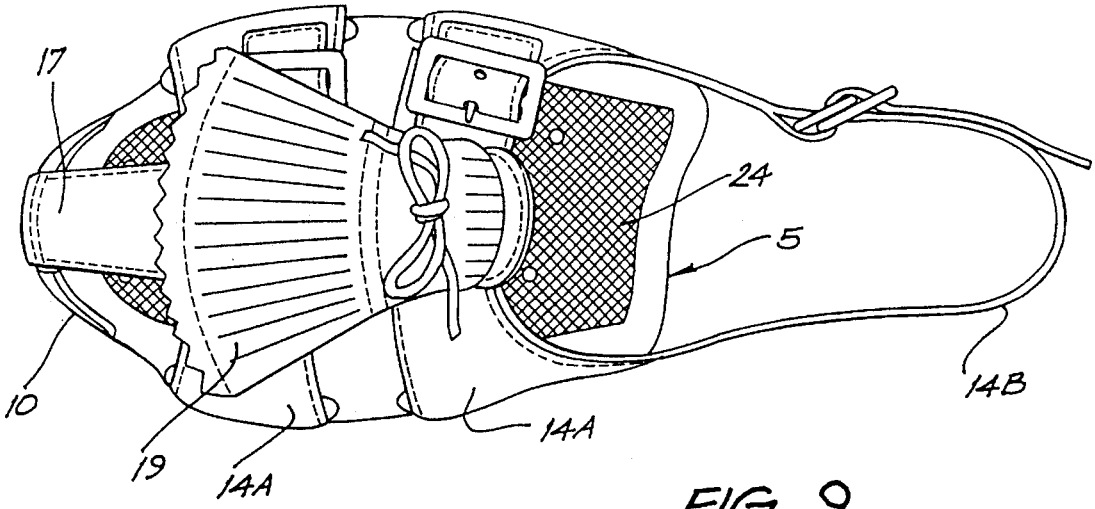
FIG. 9 is a top view of another embodiment of the invention.
Figure 10:
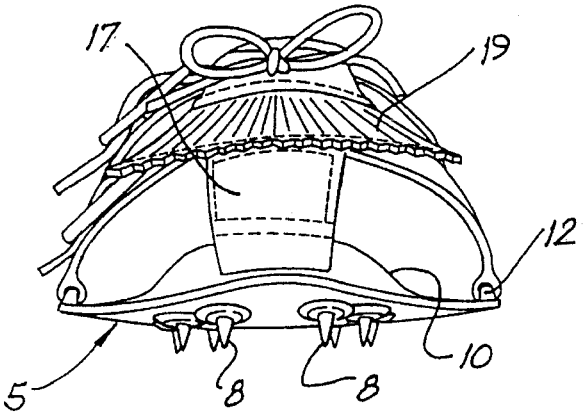
FIG. 10 is a front elevation of the embodiment of FIG. 9.
Figure 11:
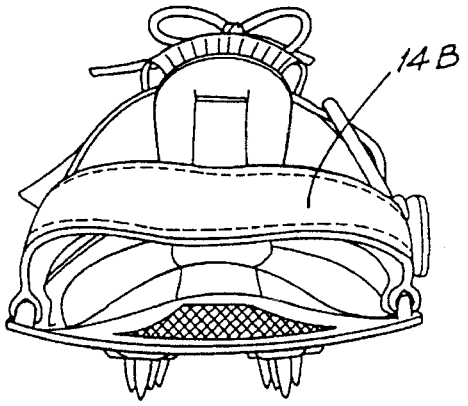
FIG. 11 is a rear elevation of the embodiment of FIG. 9.
Figure 12:
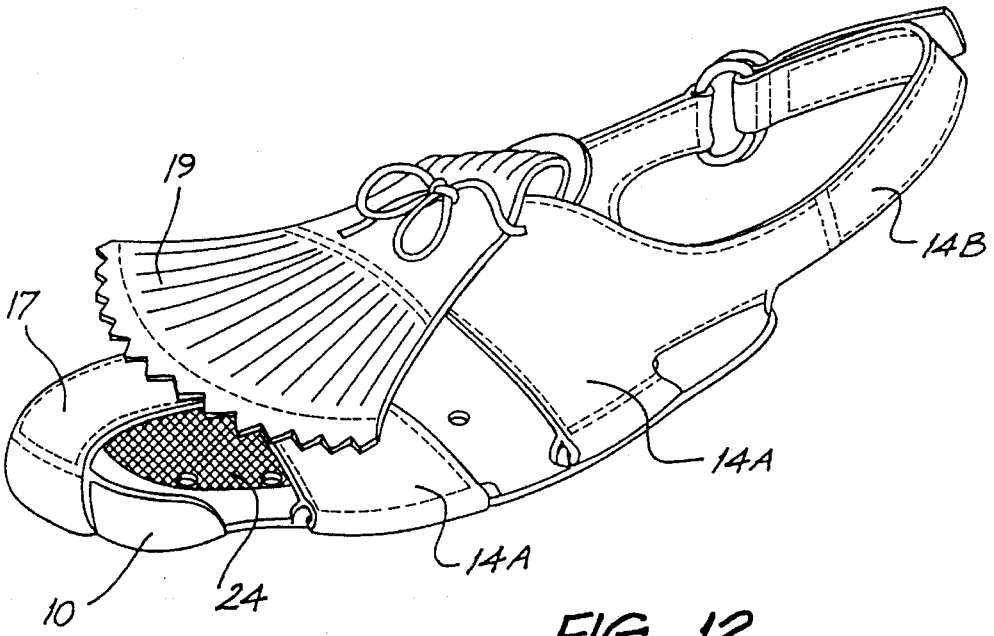
FIG. 12 is a perspective view of the embodiment of FIG. 9.

A second pair of straps 14, attached to the soleplate 5 rearwards of the first pair, each branch into a pair of straps so that one strap 14A from each branching passes over the top of the front portion of the user's footwear 15 to be fastened to one another, and the other strap of each branching 14B passes around the heel of the footwear 15 to be fastened to one another. Again buckle means 16 is shown as the fastener in FIG. 4, but other means may be used, such as that shown in FIG. 9.

The toe strap 17 is provided with two slots which extend in a longitudinal direction. One strap of each pair passing over the top of the front portion of the footwear 15 passes through a slot 18 in the toestrap 17, so that all five straps passing over the front portion of the footwear 15 are securely linked together to firmly grip the footwear 15. The toe strap 17 has a long and wide top 19 to fold down over the opening of the footwear 15 to prevent the ingress of dirt, sand, etc.

Figure 13:
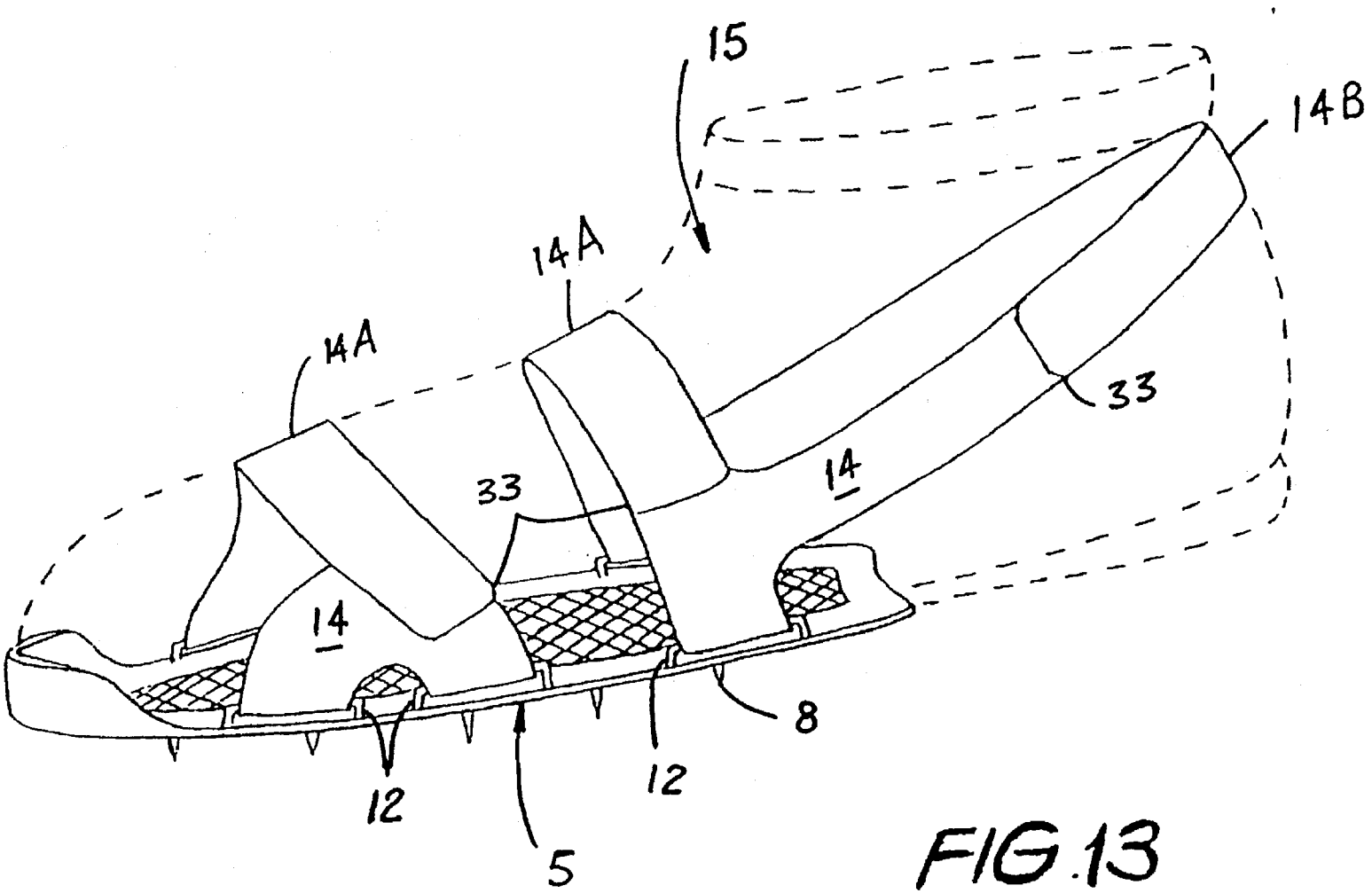
FIG. 13 shows an embodiment of this invention fitted by a further alternative arrangement to the shoe of a user.

Alternatively, as depicted in FIG. 13, the straps 14A, 14B may be joined by strips 33 made of (VELCRO), (a registered trademark), which is a synthetic material which adheres when pressed together.

Whereas a preferred embodiment has been described in the foregoing passages, it should be understood that other forms, refinements and modifications are feasible within the scope of the invention.

I claim:

1. An accessory for attachment to the sole of a shoe having a continuous unstepped undersurface to allow the wearing of the shoe for the playing of golf, said accessory comprising:

a thin, flexible soleplate of an elastic plastic material having an upper surface and a lower surface, the soleplate being generally dish-shaped both longitudinally and transversely in its relaxed state with a concave upper surface, and being adapted to deflect resiliently to be generally flat when worn by the user; and at least two curved rows of spikes protruding from the lower surface of the soleplate, each said row of spikes comprising five spikes, the rows being disposed along the length of the soleplate and being curved outwards, away from the center of the soleplate, said soleplate further comprising an axis point located between and generally midway along the length of the rows, the spikes being paired and each spike of each said pair being located such that a straight line drawn through a pair of spikes also passes through the axis point, each of the pair of spikes being equidistant from the axis point.

2. The accessory of claim 1, further comprising:

a plurality of apertured protrusions around the periphery of said soleplate and projecting upwardly therefrom; and a plurality of straps passing through said apertures and secured to said protrusions for removably attaching said soleplate to the footwear.

3. The accessory of claim 1, further comprising:

a plurality of metal attachment members around the periphery of said soleplate and projecting upwardly therefrom; and a plurality of straps passing around said attachment members and secured to said attachment members for removably attaching said soleplate to the footwear.

4. The accessory of claim 3, wherein each metal attachment member has at least one thin, broad base, said broad base being embedded within said soleplate.

5. The accessory of claim 1, wherein said soleplate further comprises an upper layer and a lower layer laminated thereto.

6. The accessory of claim 1, wherein the upper surface is irregular to increase the grip between the upper surface and the sole of the footwear.

7. The accessory of claim 6, wherein the lower layer consists of a wear resistant material.

8. The accessory of claim 1, wherein said spikes are of metal.

9. The accessory of claim 8, wherein each spike is disposed normally to said soleplate and comprises a shaft defining an axis and a thin, broad base connected to the shaft and normal to the axis of the shaft, said broad base being embedded within said soleplate.

10. The accessory of claim 1, wherein the thickness of said soleplate is increased in the region of each spike forming a boss around each spike.

11. The accessory of claim 10, wherein each said boss has a substantially flat lower surface.

12. The accessory of claim 1, wherein the footwear includes a forward portion and a heel, the accessory further comprising: at least one pair of straps which pass over the forward portion of the footwear and at least one strap which passes around the heel of the footwear.

13. The accessory of claim 2, wherein said soleplate includes a front, the accessory further comprising: one apertured protrusion located at the front of said soleplate, forming a toeplate for locating the toe of the footwear relative to the soleplate.

14. The accessory of claim 3, wherein said soleplate includes a front, the accessory further comprising: one attachment member located at the front of said soleplate, forming a toeplate for locating the toe of the footwear relative to the soleplate.

15. The accessory of claim 1, wherein straps for securing said soleplate to the footwear are removably attachable to at least one of other straps by buckle means attached to a first strap and a second strap attached to the first strap by engaging with said buckle means.

16. The accessory of claim 13, wherein said toeplate has a strap attached thereto, said toeplate strap being located longitudinally along the top of the front portion of the footwear, said toeplate strap having at least one aperture therein, with at least one of the other straps passing over the front portion of the footwear passing through said toe strap aperture(s), thereby locating said toeplate strap, and said toeplate strap adapted to at least partially cover the footwear, thereby reducing the ingress of sand or dirt into the footwear.

17. The accessory of claim 1, wherein the thickness of said soleplate, excluding the bosses and any protrusions, is within the range of 1.25 mm to 1.5 mm.

18. The accessory of claim 1, wherein the footwear has a certain width and wherein the width of said soleplate is up to 20% wider than the width of the footwear.

* * * * *